US005858316A

United States Patent [19]

Berndt et al.

[11] Patent Number: 5,858,316

[45] Date of Patent: Jan. 12, 1999

[54] PROCESS AND DEVICE FOR REMOVAL AND OXIDATION OF ORGANIC SUBSTANCES FROM KITCHEN VAPOR

[76] Inventors: Malte Berndt, Zur Schanz 8; Martin Meister, Augrund 52, both of D-74889 Sinsbeim, Germany

[21] Appl. No.: 596,377

[22] PCT Filed: Aug. 24, 1994

[86] PCT No.: PCT/EP94/02796

§ 371 Date: Jun. 26, 1996

§ 102(e) Date: Jun. 26, 1996

[87] PCT Pub. No.: WO95/06227

PCT Pub. Date: Mar. 2, 1995

[30] Foreign Application Priority Data

Aug. 24, 1993 [DE] Germany ..... 43 28 405.1

[51] Int. Cl.[6] ..... B01D 53/44; F24C 15/20

[52] U.S. Cl. ..... 423/245.3; 422/168; 422/177; 422/178; 126/16; 126/299 F; 55/DIG. 36

[58] Field of Search ..... 423/245.3, 213.7; 126/299 R, 299 F, 16; 55/DIG. 36; 422/168, 177, 178

[56] References Cited

U.S. PATENT DOCUMENTS

| | | | |
|---|---|---|---|
| 2,658,742 | 11/1953 | Suter et al. | 55/DIG. 36 |
| 4,235,220 | 11/1980 | Hepner | 126/299 D |
| 4,985,210 | 1/1991 | Minami | 422/169 |
| 5,140,811 | 8/1992 | Minami | 60/297 |

FOREIGN PATENT DOCUMENTS

| | | | |
|---|---|---|---|
| A 23 63 820 | 6/1975 | Germany . | |
| A 34 47 481 | 7/1986 | Germany . | |
| 3636250 | 4/1988 | Germany | 423/245.3 |
| 3715598 | 11/1988 | Germany | 126/16 |
| A 41 42 336 | 6/1993 | Germany . | |
| A 50 09 61 78 | 4/1993 | Japan . | |

OTHER PUBLICATIONS

English Translation of DE 23 63 820 A, Jun. 1975.

English Translation of JP 5–96, 178 A, Apr. 1993.

*Primary Examiner*—Gary P. Straub
*Assistant Examiner*—Timothy C Vanoy
*Attorney, Agent, or Firm*—Dvorak & Orum

[57] ABSTRACT

A process and device for removing and oxidizing organic substances from an extracted air stream. The air stream is flowed through a filter which adsorbs the organic material, where the airstream is bypassed around a catalyst until the filter is saturated. At saturation a heater supplies heat to the filter to desorb the organic material. The catalyst is heated by another heater at the desorption period and receives the organic material and extracted air stream to oxidize the organic substances.

12 Claims, 3 Drawing Sheets

PROCESS AND DEVICE FOR REMOVAL AND OXIDATION OF ORGANIC SUBSTANCES FROM KITCHEN VAPOR

This application is the national U.S. stage of parent case PCT/EP94/02796, filed Aug. 24, 1993.

BACKGROUND OF THE INVENTION

1. Field of the Invention

The invention deals with a process and a device for the removal and oxidation of organic substances from kitchen vapor contained in an extracted air stream by utilizing a ventilator generating the extracted air stream in an extracted air channel, a filter adsorbing the organic substances and a heated catalyst performing the catalytic oxidation of the organic substances.

2. Description of the Prior Art

Kitchen vapor which, in a broader sense, includes vapor generated during the manufacture and preparation of food stuff and food, for example, by bakeries or chocolate manufacturers, contains mostly organic substances which can become, depending on their concentration and the location of their emission point, a real nuisance to the surrounding area due to their smell, and can lead to other undesirable manifestations, such as, for example, deposits accompanied by mold formation.

For this reason efforts are made to capture the vapor, preferably by extracting it, and to channel the extracted air carrying the vapor through filters, among other methods, in order to remove organic substances. However, the absorption capacity of each and every filter is limited, so that, as it becomes saturated, it works less effectively and may even cease to function altogether. Filter replacement is laborious and costly, and can present a waste disposal problem.

From the German patent disclosure document 23 63 820, a device is known which channels extracted air carrying organic substances immediately following prefiltering through a heated catalyst, located upstream of a filter and a ventilator, for catalytic oxidation of the organic substances. This device has the disadvantage that the catalyst has to be heated continuously as long as the ventilator is running and supplying polluted extracted air. In order to be effective catalysts are generally provided with a large specific surface area which, however, entails transmission of energy to the extracted air stream as it flows through the catalyst, especially when the extracted air carries steam. The expenditure of energy and the costs associated with keeping the catalyst continuously at operating temperature are correspondingly high. In addition, the organic substances in the extracted air stream, occurring generally in only relatively low concentrations, can contribute only insignificantly to the heating of the catalyst through their exothermal oxidation, because of the high flow rate of extracted air.

SUMMARY OF THE INVENTION

The object of the invention is therefore to embody and further develop the process and the device of the type described previously, in a manner that reduces the energy expenditure for extracted air purification.

According to the invention the filter is regenerated through input of heat, and the catalyst is heated only during limited time periods, thereby conserving energy when catalytically oxidizing the organic substances. This can be accomplished by diverging from the state of the art, in that the organic substances of the kitchen vapor are not continuously subjected to catalysis, but are first adsorbed in and temporarily stored by the filter, then converted from time to time in the heated catalyst following desorption of the organic substances from the filter by application of heat, a process which requires the filter to be positioned upstream of the catalyst.

Desorption of the filter takes place at the latest when the filter is saturated with organic substances. The catalytic oxidation of the organic substances takes place at the same time, preferably when the kitchen is idle, for example, at night.

The catalytic oxidation of organic substances which were previously adsorbed and accumulated in a filter clearly requires less time and energy, because of the more concentrated conversion process, than the one which, in keeping with the state of the art, has to be operated continuously as long as the organic substances are supplied by the extracted air stream.

There are two possibilities to execute or to embody the invention, respectively. In both possibilities the organic substances supplied by the extracted air stream are first adsorbed in a filter. This filter preferably consists of a material made from zeolites. Because of their specific chemical and physical characteristics which can be altered in a wide range during their manufacture, zeolites have a particularly high adsorption capacity, especially for gaseous substances. Those zeolites having hydrophobic properties and therefore selectively adsorb organic substances in kitchen vapor but not the steam adhering to the kitchen vapor, are advantageously suited for the filtering of extracted air containing kitchen vapor. Zeolites can be made available in the form of a powder bed, a granular material bed or a monolithic body. Preferably granular material beds are utilized, since they provide better throughflow than the powder beds and can be manufactured more cheaply than the monolithic body. A special property of the zeolites is their ability to reverse adsorption, i.e. they release the previously adsorbed organic substances as the temperature is increased. The desorption temperature depends, on the one hand, on the characteristic properties of the zeolite, especially on the possibly modified surface properties, and on the other, on the type of adsorbed organic substances. Suitable desorption temperatures range from 150° C. to 300° C., whereby higher desorption temperatures result in an advantageously higher desorption rate; however, desorption temperatures must not exceed a certain maximum temperature in order to avoid undesirable carbonization which could impair the ability of the zeolite, and therefore the filter, to regenerate. Zeolites or filters which again desorb organic substances when heated up, as described above, are designated in what follows as "desorbing zeolites" or "desorbing filters", respectively.

Utilizing zeolites is advantageous, since they can be heated to higher temperatures without damage as compared with the alternatively used adsorption filters which are made with activated carbon or fibrous nonwoven mats which can be desorbed only with difficulty.

One possibility of modifying the specific properties of zeolites consists in providing the surface area of the zeolites with, among others, catalytically effective substances, especially precious metal salts, which oxidize organic substances in the presence of oxygen. The catalytic effect of the zeolite and therefore the filter is activated by heat input. In this process the organic substances are catalytically oxidized in the presence of oxygen without first being desorbed. The previously adsorbing zeolite is now operated as a catalyst as long as the temperature ranges from 200° C. to 900° C., preferably from 200° C. to 450° C. Zeolites and filters which catalytically oxidize the previously absorbed organic substances through input of heat are designated in what follows "oxidizing zeolites" and "oxidizing filters", respectively.

The heating of the filter can be accomplished in many different ways. The filter can be heated directly, especially by means of an electric heating device. The filter can itself be designed as a heat exchanger, for example according to the countercurrent principle, in order to utilize waste heat that may become available for heating the filter. The filter can be heated indirectly, for example, by a heating device which is installed upstream of the filter and which heats the extracted air stream before it enters the filter. The heating device can be powered, for example, again electrically, or it can be designed as a heat exchanger.

The process according to the invention and the device of the invention are distinguished in that a "filter capable of being desorbed", especially a zeolite, is utilized as filter, and that the catalytic oxidation is achieved in a separate, but fluid mechanically connected, heated catalyst. In this arrangement the conditions for the catalytic oxidation of the organic substances are the same as for the oxidizing filter. In a further limitation to the process of the invention and in a further limitation to the device, the filter is both filter and catalyst, as previously described under "oxidizing zeolite". The number of components is thereby reduced and the device can be constructed more compact, on the whole. Another advantage of the device, with the catalyst being separate from the "desorbing filter", is the fact that the catalyst can, for example, serve several filters during their desorption phases which may occur simultaneously or at different times. This would be advantageous especially for large-scale catering establishments or commercial sized installations with several extraction points for vapor which carry organic substances. In addition, a catalyst which is separate from the filter can be installed in a branch duct which is isolated from the extracted air stream during the adsorption phase, so that the catalyst is not loaded up during the adsorption phase, especially not with steam.

The catalyst which is connected downstream of the desorbing filter can be heated either directly or indirectly by means of a heating device, whereby the kind of heating is preferably electric.

Heating devices of the "desorbing filter" and of the downstream catalyst and of the "oxidizing filter" of the present invention can be controlled independent of the ventilator which generates the extracted air stream which they heat, by means of switching units assigned to them, so that they can be operated when the filters are saturated or sooner, if necessary. The heating devices of the "desorbing filter" and of the downstream catalyst according to claim 9 can also be designed as one common heating device, or they can have one common switching unit, since desorption and catalytic oxidation in the catalyst installed downstream of the filter take place almost simultaneously. By means of certain switching circuits it can be assured that the catalyst is heated to its operating temperature just before the filter is heated up and desorption begins.

In order to prevent the catalyst of the device of the invention from being charged with condensation water when not heated during the adsorption phase, the catalyst is to be exposed to the extracted air stream coming from the filter only when heated, preferably only during the desorption phase. This is advantageously realized by bypassing the catalyst and by providing shut off devices in the bypass and/or in the section to be bypassed which are designed, for example, as controllable valves.

The heat stored in the gaseous carrier medium after the catalytic oxidation of the organic substances can at least partially be made available to the desorption process or the catalysis. This can be accomplished, for example, by channeling the heated extracted air to the filter which may be designed as a crosscurrent heat exchanger, or to a heat exchanger which is installed upstream of the filter and which is to heat the extracted air before it enters the filter. It is also possible to mix a part of the heated extracted air emerging from the catalyst with the colder extracted air entering the filter in order to heat it up, whereby a minimum oxygen content of the extracted air flowing into the filter must be maintained, however, since otherwise the subsequent catalytic oxidation will be incomplete.

BRIEF DESCRIPTION OF THE DRAWINGS

An exemplary embodiment of the invention is presented schematically in the attached illustrations.

DESCRIPTION OF THE PREFERRED EMBODIMENT

Figure 1:
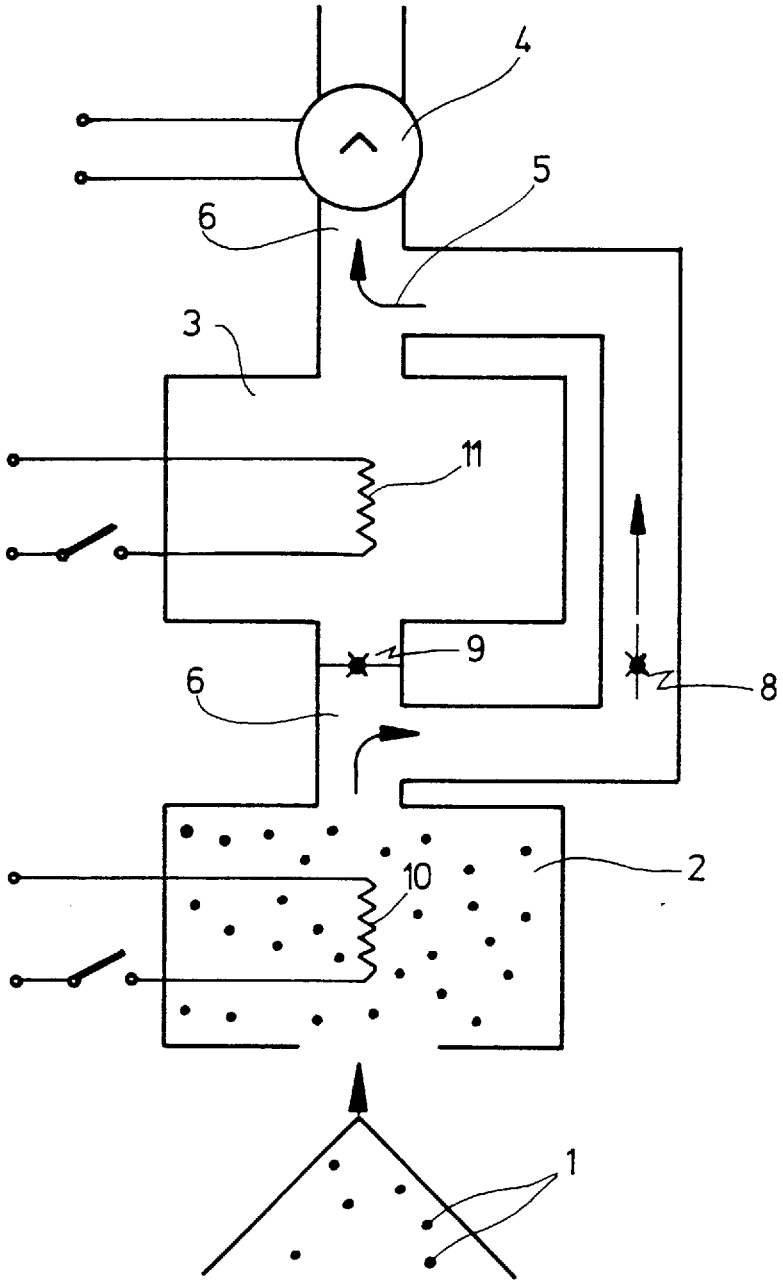
FIG. 1 shows a block diagram of a device for the removal and oxidation of organic substances 1 from kitchen vapor during the adsorption phase.
Figure 2:
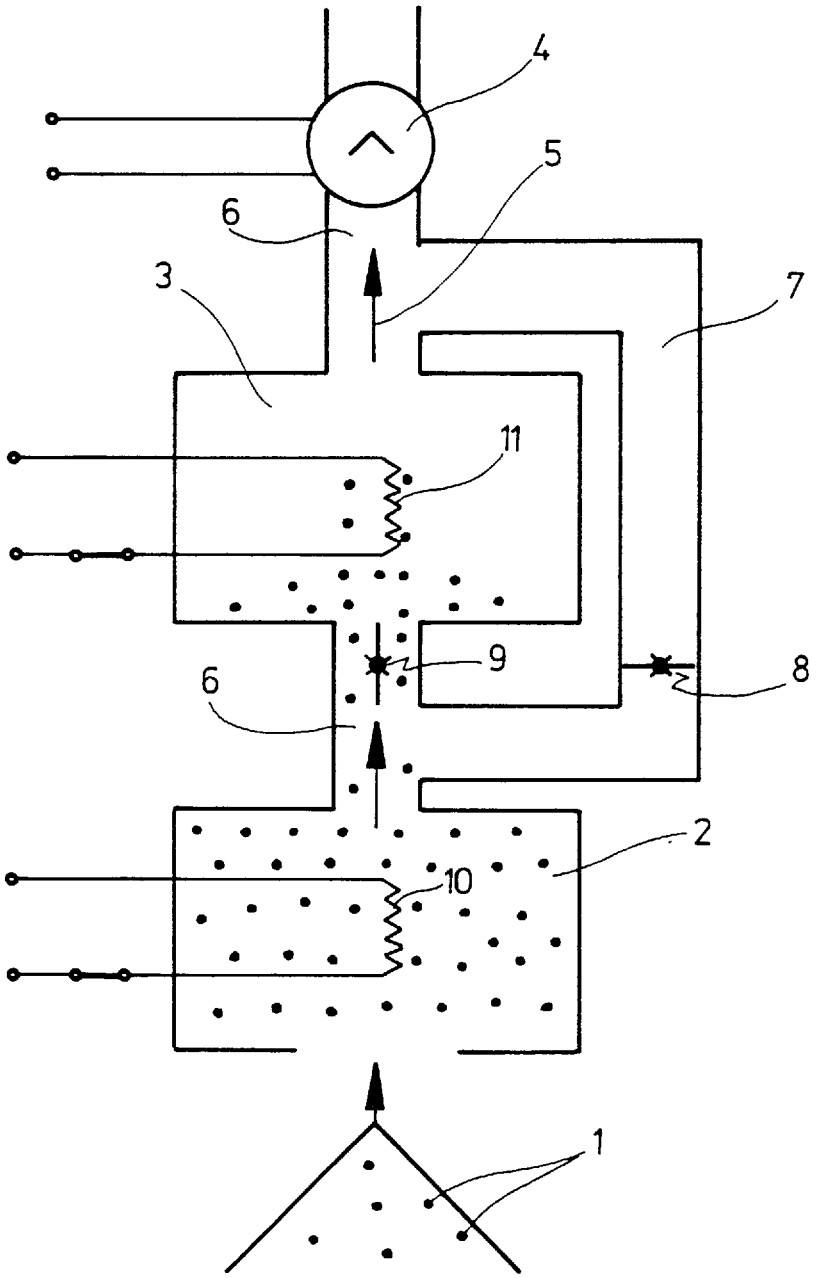
FIG. 2 shows a block diagram of the device shown in FIG. 1 during the desorption and catalysis phase.

The device consists of a filter 2, a catalyst 3 and a ventilator 4, where the latter generates an extracted air stream 5 and whereby filter 2, catalyst 3 and ventilator 4 are connected in series by means of the extracted air channel, with filter 2 located at the upstream end. The extracted air channel 6 branches off upstream of the catalyst 3 into a bypass 7 which bypasses catalyst 3 and returns into the extracted air channel 6 just upstream of ventilator 4. A first controllable shut off device 8 is installed in bypass 7. A second controllable shut off device 9 is installed in that section of the extracted air channel which bypasses bypass 7 and is located upstream of catalyst 3. A heating device 10 and 11 is integrated in filter 2 and catalyst 3, respectively, which can be controlled independent of each other and the ventilator. During the adsorption phase (FIG. 1) the shut off device 8 is open and the shut off device 9 is closed, so that extracted air stream 5 bypasses catalyst 3. The heating devices 10 and 11 are shut off, and filter 2 and catalyst 3 are at a low temperature $T_0$, whereby $T_0$ is smaller than 100° C. The organic substances 1 contained in the extracted air stream 5 are adsorbed in filter 2. The extracted air purified in this manner is drawn off by way of the bypass. At the end of the adsorption phase, i.e. when filter 2 is saturated, or as needed, catalyst 3 is heated up to its operating temperature $T_2$ ( e.g. 350° C.). As soon as it reaches this temperature the second shut off device 9 is opened, then the first shut off device 8 is closed. Following this the first heating device 10 takes filter 2 to its desorption temperature $T_1$ (e.g. 200° C.). The organic substances 1 released from the filter during the desorption phase (FIG. 2) are transported by the extracted air stream 5 to the catalyst 3 by means of the extracted air channel 6. There the desorbed organic substances 1 are then directly catalytically oxidized, and subsequently leave the device by way of the ventilator 4.

Figure 3:
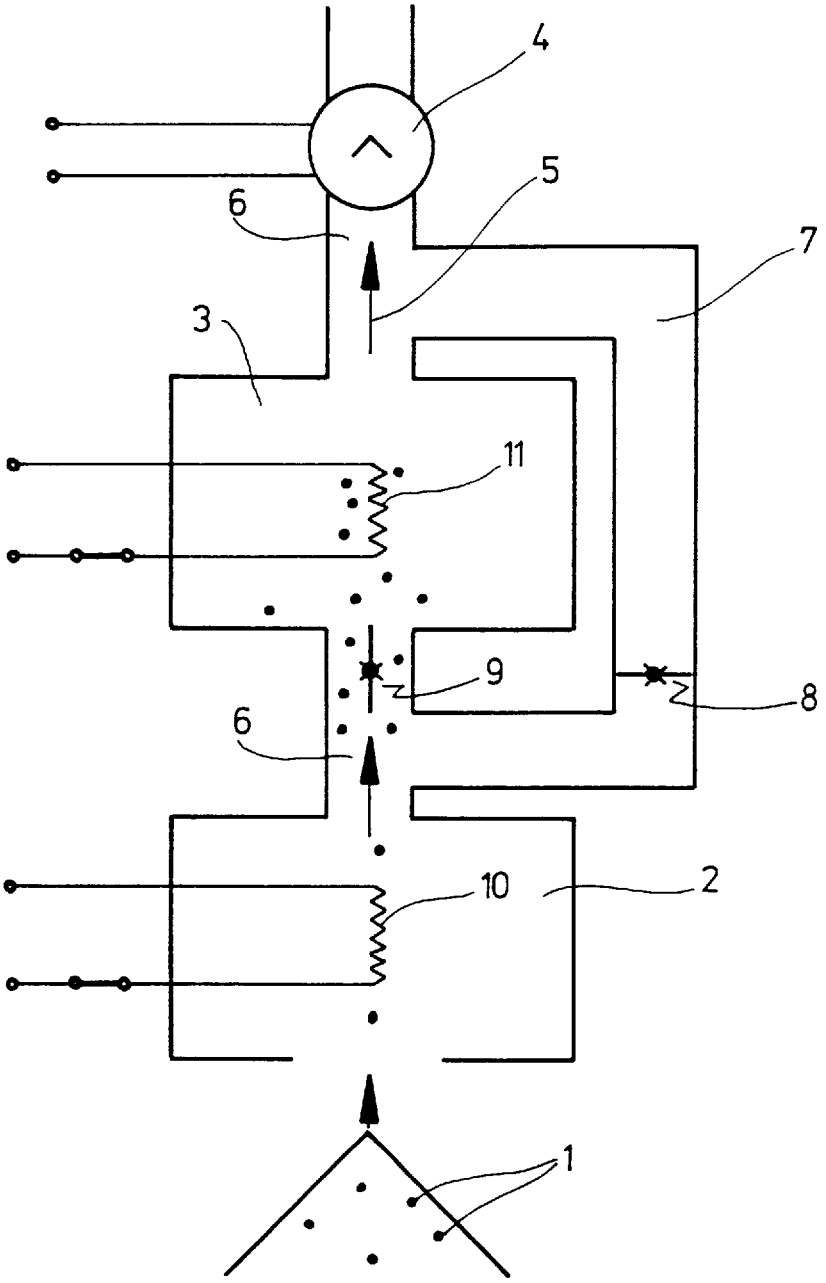
FIG. 3 shows a block diagram of the device shown in FIG. 1 at the end of the desorption phase.

After the organic substances accumulated in filter 2 are completely desorbed (FIG. 3), the first heating device 10 and the second heating device 11 are turned off again, and the first shut off device 8 is opened again and the second shut off device 9 closed again. Filter 2 is now regenerated and, after it has cooled down to $T_0$, can again adsorb organic substances 1 from the extracted air stream 5.

We claim:

1. A device for removing and oxidizing organic substances from a flowing air stream containing organic substances and water vapor, comprising:

a hydrophobic zeolite filter for adsorbing the organic substances from the air stream;

an oxidizing catalyst located downstream from said hydrophobic zeolite filter, said oxidizing catalyst for carrying out a catalytic oxidation of the organic substances desorbed from said hydrophobic zeolite filter;

an air stream channel system for continuously passing the air stream through said hydrophobic zeolite filter and for intermittently passing the desorbed organic substances through said oxidizing catalyst, said air channel system including a by-pass channel for diverting said air stream around said oxidizing catalyst for selected periods of time;

a first and a second heating means, said first heating means for intermittently heating said hydrophobic zeolite filter and said second heating means for intermittently heating said oxidizing catalyst;

a first and a second electrical circuitry device, said first electrical circuitry device for turning said first heating means to an on position when said zeolite filter is loaded with said organic substances, said second circuitry device for turning said second heating means to an on position when said organic substances are to be desorbed from the hydrophobic zeolite filter loaded with said organic substances;

valve means for controlling the flow of said air stream, said valve means opening said by-pass channel to the flow of the air stream when the air stream does not contain organic substances which have been desorbed from said hydrophobic zeolite filter and said valve means closing said by-pass channel to the flow of the air stream when the air stream contains desorbed organic substances.

2. The device according to claim 1, wherein the filter consists of zeolites which are in granulated form.

3. The device according to claim 1, wherein a valve means is provided in the air channel prior to said oxidizing catalyst in order to temporarily divert the air stream around said oxidation catalyst.

4. The device according to claim 3, wherein a second valve means is provided in the bypass in order to shut off the air stream from the bypass when the airstream flows into said oxidation catalyst.

5. The device of claim 1, wherein said air stream is comprised of kitchen fumes.

6. A process for the removal and oxidation of organic substances contained within at least one extracted air stream, said air stream comprised of a combination of organic substances and water vapor, said air stream generated from at least one source which emits said organic substances and water vapor, the process comprising the steps of:

passing the said at least one extracted air stream continuously through a hydrophobic zeolite filter so that the organic substances are adsorbed by the filter, whereas the water vapor passes said filter, thereby loading said filter with said organic substances;

placing an oxidizing catalyst downstream of said zeolite filter;

heating the loaded zeolite filter to a temperature that will desorb said organic substances from the filter, whereby said organic substances are released from said filter so as to regenerate said zeolite filter;

heating said oxidizing catalyst to a temperature above a temperature required to activate said catalyst, said catalyst being heated at one of prior to and while the organic substances are desorbed from said zeolite filter;

communicating the desorbed organic substances from said zeolite filter through said oxidizing catalyst in order to perform a catalytic oxidation of the desorbed organic substances.

7. Process according to claim 6 wherein the filter is heated when saturated with organic substances and when said organic substances are not present in the air stream.

8. Process according to claim 6, wherein the hydrophobic zeolite filter is heated to a temperature between 150° C. and 300° C., thereby constituting a desorption phase.

9. Process according to claim 8, wherein the organic substances are transported to the oxidation catalyst by means of air, which flows through the hydrophobic zeolite filter during the desorption phase.

10. Process according to claim 9, wherein the oxidation catalyst is heated to a temperature between 200° C. and 900° C., immediately prior to the desorption phase, said oxidation catalyst remaining at this temperature during the desorption phase of the hydrophobic zeolite filter.

11. Process according to claim 10, wherein the air leaves the oxidation catalyst together with the gaseous oxidation products, said air and gaseous products containing heat from said oxidation catalyst, and the heat stored in the air and gaseous products is returned to the hydrophobic zeolite filter in order to heat the hydrophobic zeolite filter.

12. The process of claim 6, wherein said air stream is comprised of kitchen fumes.

* * * * *